United States Patent [19]

Brandon

[11] 4,106,658

[45] Aug. 15, 1978

[54] PLATTER

[76] Inventor: Richard N. Brandon, c/o Marco Tool & Die 6868 Homestretch Rd., Dayton, Ohio 45414

[21] Appl. No.: 803,560

[22] Filed: Jun. 6, 1977

[51] Int. Cl.[2] ..... B65D 25/14

[52] U.S. Cl. ..... 220/453; 156/85; 220/83; 220/94 A; 264/274

[58] Field of Search ..... 264/274, 46.7, 271, 264/273; 156/84, 85; 428/57, 78, 458, 313; 220/63 R, 83, 94 A, 9 F, 65

[56] References Cited

U.S. PATENT DOCUMENTS

| | | | |
|---|---|---|---|
| 1,583,512 | 5/1926 | Worth | 220/65 |
| 2,094,257 | 9/1937 | Luck et al. | 220/63 R |
| 2,545,528 | 3/1951 | Murray | 220/17 |
| 3,164,285 | 1/1965 | Melich | 220/17 |
| 3,298,559 | 1/1967 | Lurie | 220/63 R |
| 3,305,124 | 2/1967 | Whiteford | 220/63 R |
| 3,430,803 | 3/1969 | Nelson | 220/63 R |
| 3,716,433 | 2/1973 | Plummer | 156/85 |

*Primary Examiner*—William Price
*Assistant Examiner*—Allan N. Shoap
*Attorney, Agent, or Firm*—Biebel, French & Nauman

[57] ABSTRACT

A heat retention individual serving platter has a stainless steel tray-shaped insert integrally attached to and supported on a rigid nylon filled foam underlying base. The insert is formed with a downwardly turned edge having an outwardly extending locking portion which extends into the plastic material of the base and which locks the insert in place.

5 Claims, 4 Drawing Figures

PLATTER

BACKGROUND OF THE INVENTION

In fast service food outlets, institutions and the like, there is a need for an individual serving platter having a stainless steel liner and a heat insulating underliner for serving pre-heated foods, such as steaks, hot sandwiches and the like. It has formerly been the practice to employ removable stainless steel liners which are preheated and stacked in a convenient location for receiving the food from the grill or the stove. The liner is then placed on an insulating separate underliner and served to the customer. Such a liner and underliner combination tray is disclosed herein under the description of "Prior Art". They inherently have the disadvantage of requiring that their parts be separately cleaned, handled and stored, after each use.

SUMMARY OF THE INVENTION

The present invention is directed to a unitary heat retaining serving platter which employs a stainless steel liner formed integrally with a heat insulating underliner or base. In the preferred embodiment, a stainless steel tray-insert is formed with a peripherally continuous downwardly turned edge and is encapsulated at the edge in a rigid heat insulating cellular foam base. The parts are preferably formed or joined by injection molding, and the underliner is provided with a peripheral rim which extends outwardly from the tray-shaped insert to form edges by which the platter may be gripped and handled. The metallic insert is firmly bonded to the underlying base structure at the peripheral edge of the insert, and bonding is enhanced by the fact that there is a small amount of inherent shrinkage of the plastic material after the same has been injected and has cooled, forming a permanent fluid-tight seal between the rim of the base and the downwardly turned edge of the tray-shaped insert.

Preferably, the base is formed of a heat resistant rigid foam material, such as glass-filled nylon foam. In the molding operation, a smooth impervious skin is formed along all exposed regions of the base to provide a unitary platter which is sanitary and which is resistant to boiling water and mechanical stress. Additionally, the underlying foam structure provides excellent heat retention characteristics to the insert.

It is accordingly an object of this invention to provide a serving platter which incorporates a metallic tray and an unerlying insulating base formed as an integral unit.

Another object of this invention is to provide a platter having an integral metal insert and base, the base being formed of rigid foam plastic firmly bonded about the tray.

These and other objects and advantages of the invention will be apparent from the following description, the accompanying drawings and the appended claims.

DESCRIPTION OF THE PRIOR ART

Figure 3:
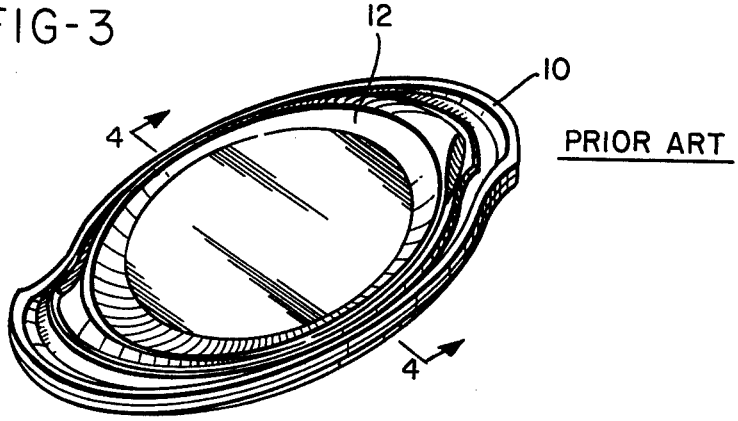
FIG. 3 is a perspective view of a prior art platter.
Figure 4:
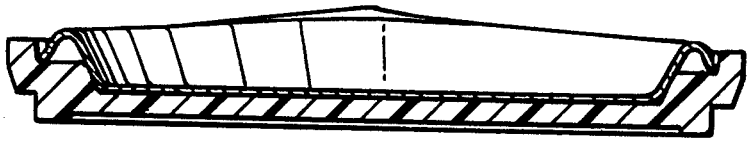
FIG-4 PRIOR ART
FIG. 4 is a transverse section through the platter of FIG. 3, taken generally along the line 4—4.

FIGS. 3 and 4 illustrate a prior art form of an individual serving platter which has been used in fast food restaurants, institutions and the like, in which a plastic injected molded base 10 loosely supports a stainless steel insert 12 on the upper surface. The platter 10 is formed with an outlying shape generally similar to that of the insert 12, but somewhat wider marginally so that the insert is carried within the outer peripheral dimensions of the base. The stainless steel insert 12 is removable for washing and cleaning. Generally, the prepared food is placed on the insert and the insert is then placed on the base 10 prior to serving. It is known to form the base 10 of a high temperature heat resistant injected plastic material, so that the same can be subjected to commercial washing operations. The purpose of the base 10 is to provide a means for conveniently handling the stainless steel insert 12 and for providing insulation so that foods placed on the insert do not readily cool.

DESCRIPTION OF PREFERRED EMBODIMENT

Figure 1:
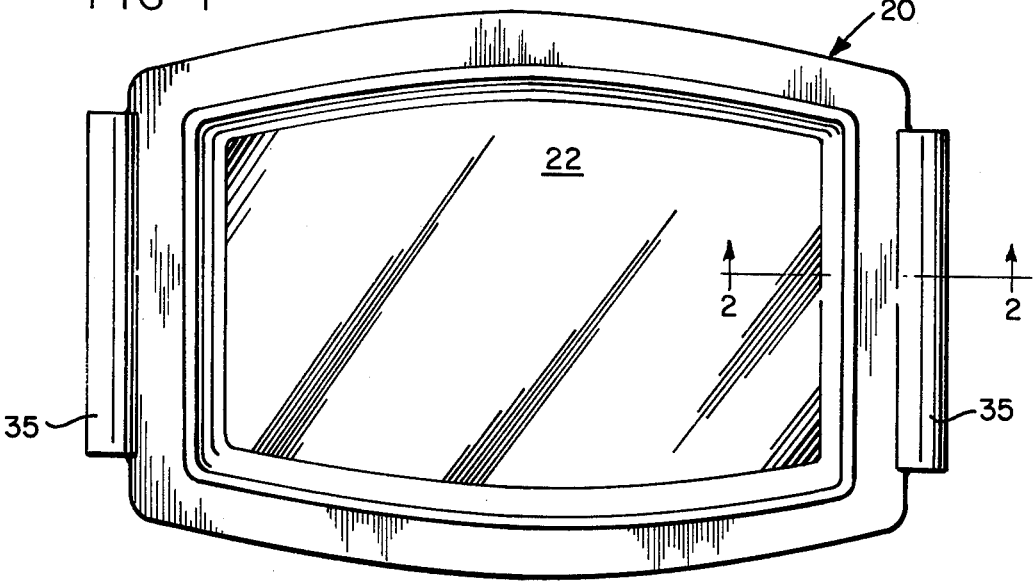
FIG. 1 is a plan view of an individual serving platter according to this invention.
Figure 2:
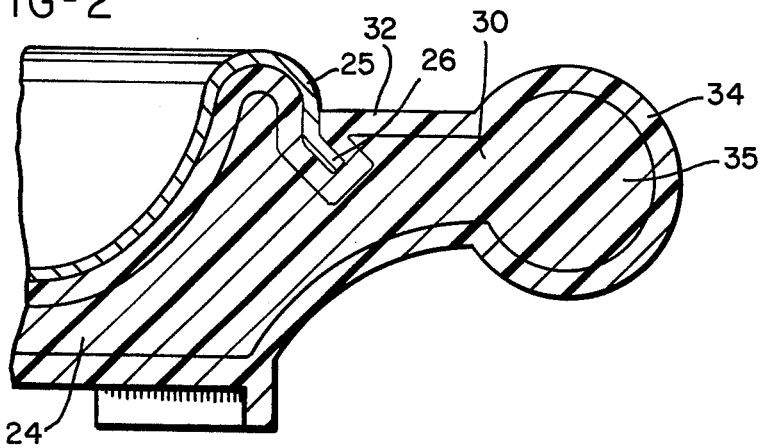
FIG. 2 is an enlarged fragmentary section taken generally along the line 2—2 of FIG. 1.

This invention is directed to a unitary heat retention individual serving platter 20, as shown in FIG. 1. The platter 20 is formed with a stainless steel insert tray 22 which is marginally encapsulated in and supported on a heat insulating base 24. The tray 22 is preferably formed of stainless steel sheet material and is provided with a peripherally continuous, downwardly turned rim or edge 25 (FIG. 2). The edge terminates in a locking portion 26. It will be seen that the peripheral edge 25 is substantially perpendicular with respect to the floor or plane of the tray 22, and the locking portion 26 thereof extends outwardly at an angle of approximately 30° from the edge 25.

The heat insulating base 24 is preferably formed of a rigid cellular high strength and high temperature foam material which is injected within a suitable mold cavity about the tray 22, in generally underlying relation to the insert tray. Thus, the base 24 is in fully underlying relation to all parts of the tray 22. In addition, the base 24 is formed with a peripheral rim portion 30 which extends outwardly of the downwardly turned edge 25 and fully and completely surrounds the edge. The upper surface of the rim portion 36 joins the edge 25 by a flat or planar upper surface 32. The upper surface 32 lies in a plane which is intermediate the upper and lower extremeties of the edge 25 and fully encapsulates the peripheral locking portion 26, thereby trapping the insert tray in place.

Firm bonding with the tray 22 at the rim 25 is caused by reason of the inherent shrinkage of the plastic material forming the base 24 following injection and cooling. It is preferable to form the base 24 of a high temperature and high strength material such as a glass filled nylon with a foaming agent, which may be injected at temperatures of around 500° F. Suitable products are sold under the trademark "Nylafil" by Fiberfil Division, Dart Industries, Evansville, Indiana, although it will be obvious to a person skilled in the art that other suitable plastic materials may also be employed.

The glass-filled nylon foam forms an essentially impervious surface skin 34 which may extend to a depth of 0.030 inches to 0.050 inches. The skin 34 extends over all of the outer portions of the base 24 and in underlying relation to the insert 22, as shown in FIG. 2. If desired, the base 24 may also be provided with a pair of opposite integral handles 45 for ease of handling.

The platter of this invention provides a stainless steel insert permanently received on and locked to a heat insulating base 24. The inherent shrinkage of the rigid plastic foam material of the base assures intimate bonding between the base and the insert at the downwardly turned rim 25, while the outwardly turned locking portions 26 serve to prevent separation of the insert from the base, in spite of rough handling, dropping and the like. The unitary individual serving platter of the present invention may thus be machine washed, boiled or handled in conventional commercial dishwashing apparatus while retaining an attractive appearance over a long service life.

While the form of apparatus herein described constitutes a preferred embodiment of this invention, it is to be understood that the invention is not limited to this precise form of apparatus, and that changes may be made therein without departing from the scope of the invention.

What is claimed is:

1. A heat retention individual serving platter comprising a stainless steel tray-shaped insert formed with a peripherally continuous, downwardly turned edge terminating in a locking portion, and a rigid heat insulating cellular foam base molded in conforming underlying relation to said insert and having a peripheral rim extending outwardly from said edge in a plane intermediate the upper and lower extremities of said edge encapsulating said locking portion therein and trapping said insert in place.

2. The platter of claim 1 in which said insert edge is formed with a perpendicularly, downwardly extending portion terminating in said locking portion extending at an angle outwardly of said downwardly extending portion, and in which said plane intersects said edge at said downwardly extending portion.

3. The platter of claim 2 in which said base is a glass-filled nylon foam which is injection-molded and which is firmly bonded against said downwardly extending portion by reason of shrinkage of said base following injection.

4. A heat retention individual serving platter comprising a stainless steel tray-shaped insert formed with a peripherally continuous, downwardly turned vertical edge, terminating in an outwardly flared locking portion, a rigid heat insulating cellular foam base molded in conforming underlying relation to said insert, said base having a peripheral rim extending outwardly from said edge in a plane intersecting said vertical edge marginally encapsulating said locking portion therein and trapping said insert in place.

5. A heat retaining unitary serving platter comprising a sheet metal tray having a raised margin terminating in a peripherally downwardly turned edge, a rigid heat insulating plastic molded base in conforming underlying relation to the bottom surface of said tray with a peripheral rim extending outwardly of said raised portion, said edge being continuously embedded into said base inwardly of said rim encapsulating and locking said tray and said base together in a unitary construction.

* * * * *